US008100312B2

(12) United States Patent
Travini et al.

(10) Patent No.: US 8,100,312 B2
(45) Date of Patent: Jan. 24, 2012

(54) VARIABLE LINEAR GEOMETRY MACHINE FOR CONTINUOUSLY FORMING SQUARE TUBES

(75) Inventors: Vittorio Travini, Borgo San Siro (IT); Livio Travini, Borgo San Siro (IT)

(73) Assignee: Olimpia 80 S.r.l., Borgo San Siro (Pavia) (IT)

( * ) Notice: Subject to any disclaimer, the term of this patent is extended or adjusted under 35 U.S.C. 154(b) by 0 days.

(21) Appl. No.: 12/836,091

(22) Filed: Jul. 14, 2010

(65) Prior Publication Data

US 2011/0017804 A1 Jan. 27, 2011

(30) Foreign Application Priority Data

Jul. 21, 2009 (IT) ..... MI2009A1284

(51) Int. Cl.
*B23K 37/00* (2006.01)
*B21D 39/02* (2006.01)

(52) U.S. Cl. ..... 228/17.5; 228/147; 72/51; 72/52

(58) Field of Classification Search ..... None
See application file for complete search history.

(56) References Cited

U.S. PATENT DOCUMENTS

| | | | | |
|---|---|---|---|---|
| 2,950,376 | A * | 8/1960 | Wogerbauer | 219/67 |
| 2,997,904 | A * | 8/1961 | Gotsch et al. | 83/37 |
| 4,310,740 | A * | 1/1982 | Nakazima | 219/61.11 |
| 5,319,952 | A | 6/1994 | Cadney | |
| 5,802,903 | A * | 9/1998 | Nakajima | 72/224 |
| 5,868,299 | A * | 2/1999 | Abbey, III | 228/147 |
| 6,732,434 | B2 * | 5/2004 | Luo et al. | 29/897.2 |
| 7,134,456 | B2 * | 11/2006 | Maeda et al. | 138/156 |
| 2002/0000295 | A1 * | 1/2002 | Kasai et al. | 156/289 |
| 2005/0082345 | A1 * | 4/2005 | Nicolai et al. | 228/151 |
| 2008/0230586 | A1 * | 9/2008 | Kenmochi et al. | 228/144 |
| 2008/0286077 | A1 * | 11/2008 | McGlinchy | 414/222.02 |
| 2008/0302160 | A1 * | 12/2008 | Wang et al. | 72/221 |
| 2010/0193064 | A1 * | 8/2010 | Takada | 138/156 |

FOREIGN PATENT DOCUMENTS

| | | |
|---|---|---|
| DE | 44 42 434 | 10/1995 |
| EP | 1 393 830 | 3/2004 |
| GB | 1 433 431 | 4/1976 |
| JP | 57-088916 A * | 6/1982 |

(Continued)

OTHER PUBLICATIONS

Italian Search Report, MI20091284, Apr. 15, 2010.

*Primary Examiner* — Kiley Stoner
(74) *Attorney, Agent, or Firm* — Young & Thompson

(57) ABSTRACT

A machine for continuously forming square tubes includes, in sequence, forming stations suitable for progressively bending a sheet strip, at least one finishing station suitable for further approaching the edges of the bent sheet strip for the final welding and at least one station for closing the square tube. In a forming station, the axes of rotation of the lower rolls of each pair of forming rolls are horizontal and aligned to each other. Each finishing station includes an idle forming roll placed below the square tube being formed; two idle forming rolls, placed at the sides of the square tube being formed, performing movements in opposite directions, parallel to the plane of the sheet strip and two idle forming rolls placed above the square tube being formed, performing movements orthogonal to the plane of the sheet strip.

11 Claims, 7 Drawing Sheets

FOREIGN PATENT DOCUMENTS

Figure 1A:
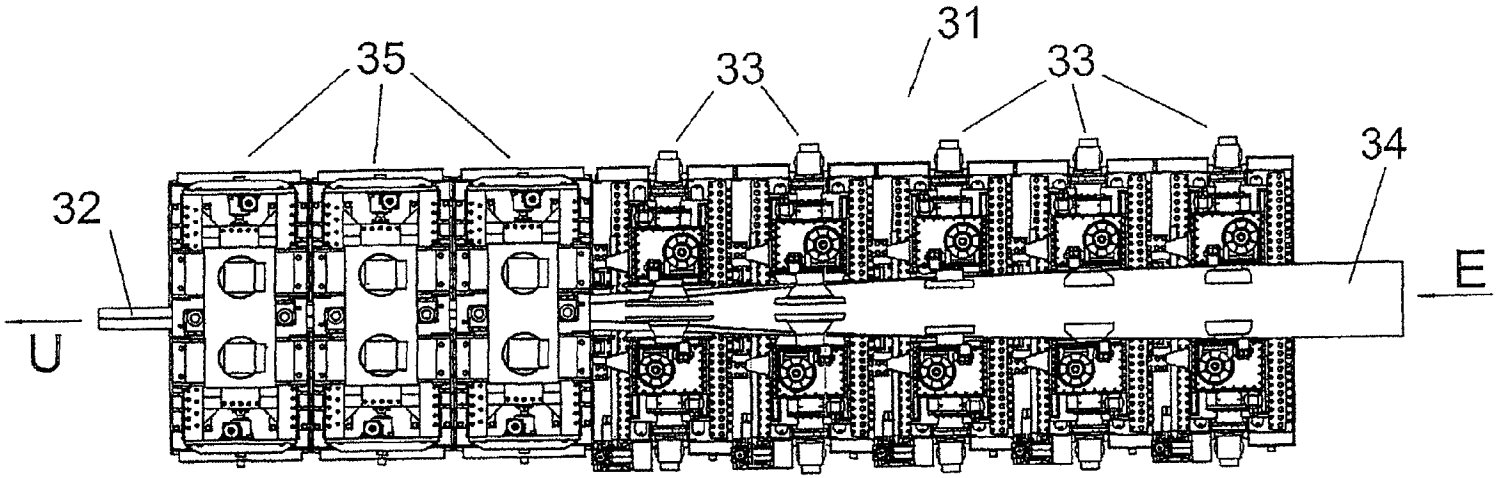

| | | | | |
|---|---|---|---|---|
| JP | 59-101222 | A | * | 6/1984 |
| JP | 60-174260 | A | * | 9/1985 |
| JP | 60-223612 | A | * | 11/1985 |
| JP | 61-137625 | A | * | 6/1986 |
| JP | 63-154268 | A | * | 6/1988 |
| JP | 01-053723 | A | * | 3/1989 |
| JP | 04-041006 | A | * | 2/1992 |
| JP | 06-279857 | A | * | 10/1994 |
| JP | 06-330177 | A | * | 11/1994 |
| JP | 2002-113517 | A | * | 4/2002 |
| JP | 2002-321016 | A | * | 11/2002 |
| JP | 2004-283844 | A | * | 10/2004 |
| WO | WO 2007/129387 | A | * | 11/2007 |

* cited by examiner

VARIABLE LINEAR GEOMETRY MACHINE FOR CONTINUOUSLY FORMING SQUARE TUBES

BACKGROUND OF THE INVENTION

1. Field of the Invention

The object of the present invention is a "variable linear geometry" machine for continuously forming square tubes (i.e. square or rectangular profiles), comprising a plurality of forming stations for progressively bending a sheet strip, followed by at least one finishing station for further approaching, for the final welding, the edges of the sheet strip bent by the forming stations and by at least one final welding station of the square tube.

2. Description of the Related Art

Machines for forming square tubes by continuously bending sheet strips are well known in the art and include, in sequence, a plurality of stations in which the sheet strip is progressively deformed by pairs of conjugate rolls, i.e. having grooves presenting complementary profiles.

Such known machines present a disadvantage in that they necessitate the replacement of the pairs of rolls when one desires (or needs) to change the dimension of the tube to be produced, which leads to variable machinery downtime delays reducing system productivity.

To overcome the aforesaid serious drawback, machines for forming square tubes by continuously bending sheet are suggested in which the upper rolls of the pairs of rolls of the forming stations perform a movement along an oblique axis, placed along the bisecting line of the groove of the corresponding lower roll, which allows the same pairs of rolls to be used for producing square tubes whose dimensions fall within a more or less wide range.

In some of the known machines for forming square tubes, each station includes just one pair of rolls, bending only one edge (alternatively, the right and the left one) of the sheet strip: such machines are bulky and expensive since they must include a high number of forming stations.

SUMMARY OF THE INVENTION

The object of the present invention is to provide a "variable linear geometry" machine for forming square tubes, which improves the performance of known forming machines since it allows to increase the size range of square tubes that can be produced without having to replace the pairs of rolls.

A machine for continuously forming square tubes according to the invention comprises, in sequence, forming stations that progressively bend a sheet strip, at least one finishing station for further approaching edges of the bent sheet strip for the final welding and at least one final welding station of the square tube.

Each forming station comprises two pairs of motorized forming rolls mounted onto horizontal axes (i.e. parallel to the plane of the sheet strip), which are faced to each other and perform horizontal movements in the opposite direction to adjust their distance to the width of the sheet strip; the upper rolls of each pair further perform horizontal movements and/or vertical movements (i.e. parallel and/or orthogonal to the plane of the sheet strip) to adjust at least their distance and that from the lower rolls to the thickness of the sheet strip.

The horizontal movements of the two pairs of forming rolls are contemporary, the horizontal and vertical movements of the upper roll of a pair of forming rolls are preferably independent from the horizontal and vertical movements of the other upper roll of the same pair of forming rolls.

Without departing from the scope of the invention, the upper rolls of two pairs of forming rolls facing each other can perform horizontal and/or vertical movements of the same width.

The axes of rotation of the lower rolls of each pair of forming rolls are aligned with each other.

Each forming station further comprises two shoulders that carry means suitable for allowing the forming rolls of the forming station to perform the aforesaid movements.

Each finishing station comprises an idle forming roll placed below the square tube being formed and having a cylindrical shape, two idle forming rolls, placed to the sides of the square tube being formed and having a frustoconical shape, that perform horizontal movements to adjust their distance to the sheet strip width and two idle forming rolls, placed above the square tube being formed and having a biconical shape, which perform vertical movements to adjust at least their distance and that from the lower rolls to the size of the tube being formed.

The horizontal movement of the forming roll placed at one side of the square tube being formed is preferably independent from the horizontal movement of the forming roll placed at the other side of the square tube being formed; the vertical movement of one of the forming rolls placed above the square tube being formed is preferably independent from the vertical movement of the other forming roll placed above the square tube being formed.

Without departing from the scope of the invention, the two forming rolls placed to the sides of the square tube being formed can perform horizontal movements of the same amplitude and/or the two forming rolls placed above the square tube being formed can perform vertical movements of the same amplitude.

Each finishing station further comprises a shoulder that carries means suitable for allowing the forming rolls placed on the sides of the square tube being formed and those placed above said tube to perform the aforesaid movements.

A machine according to the invention is called "variable linear geometry" machine because it allows the production of square tubes of different sizes by changing the reciprocal position of the pairs of rolls and/or at least one of the rolls of each pair.

BRIEF DESCRIPTION OF THE DRAWING FIGURES

Figure 1B:
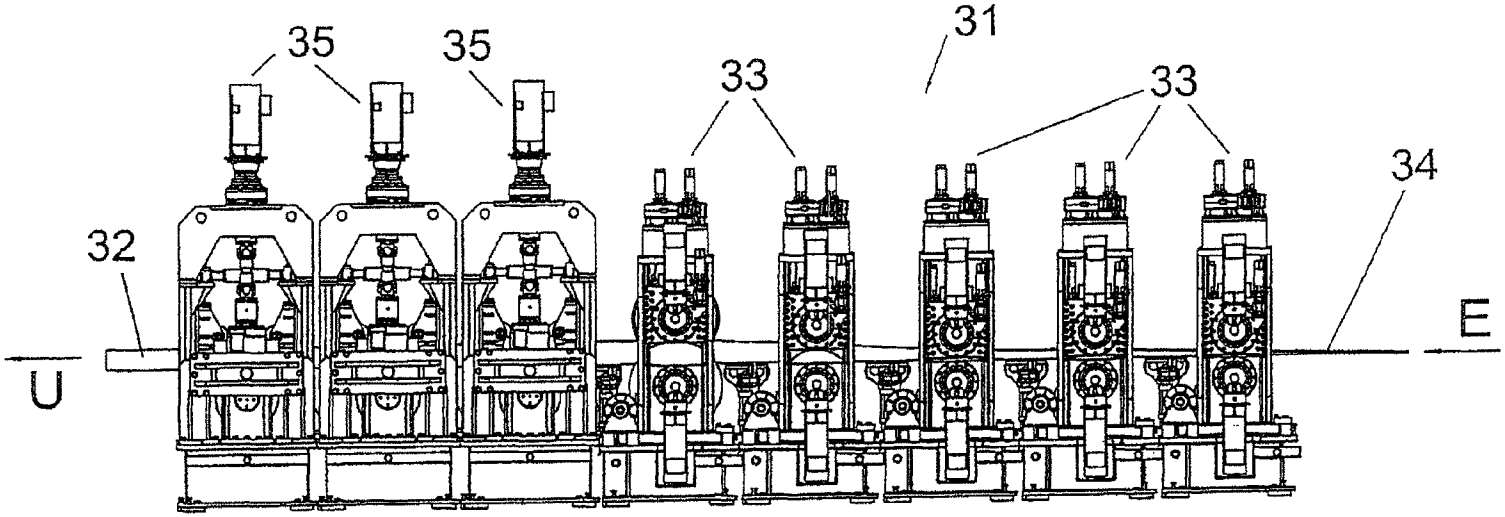
Figure 2:
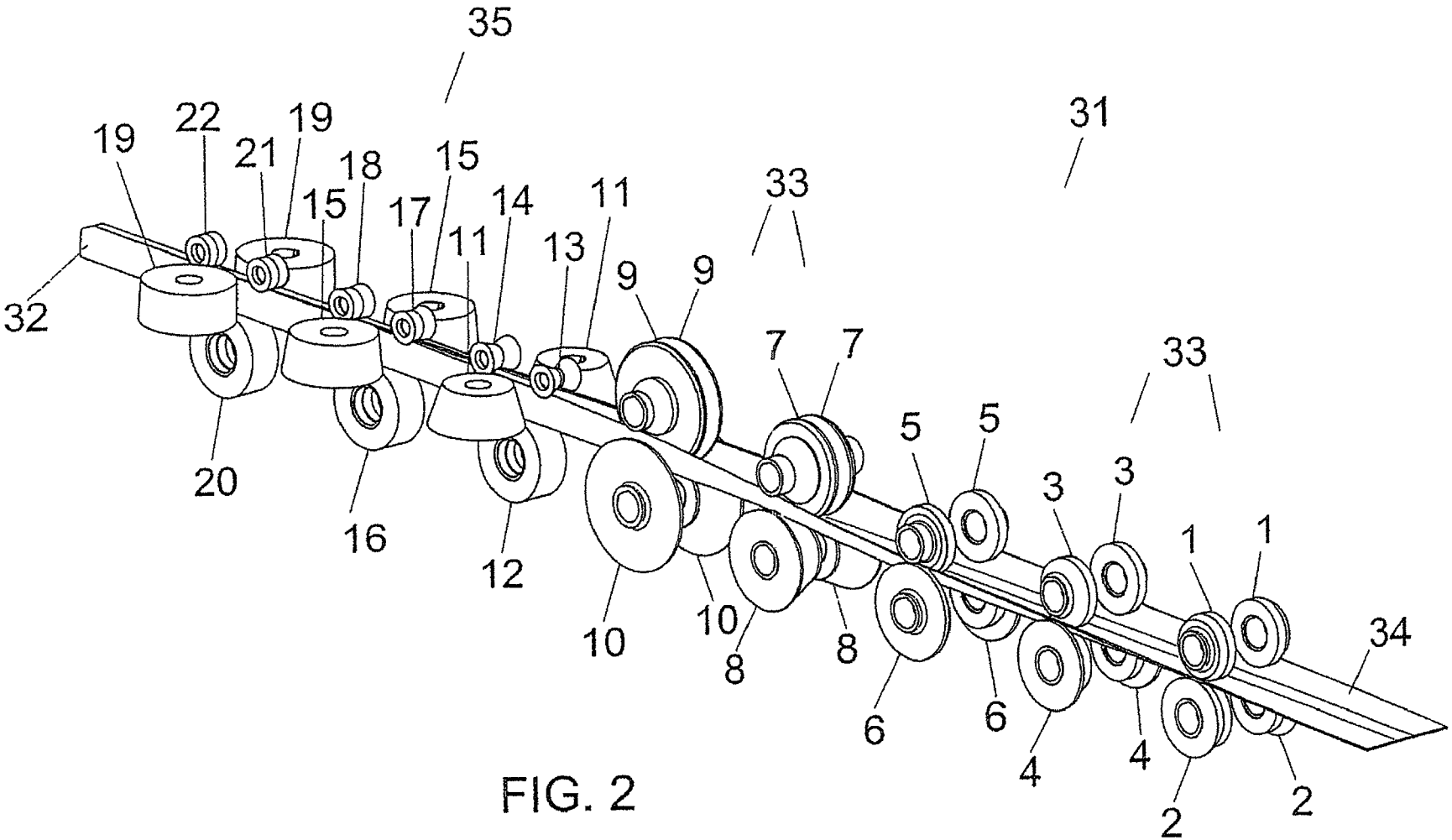
Figure 3A:
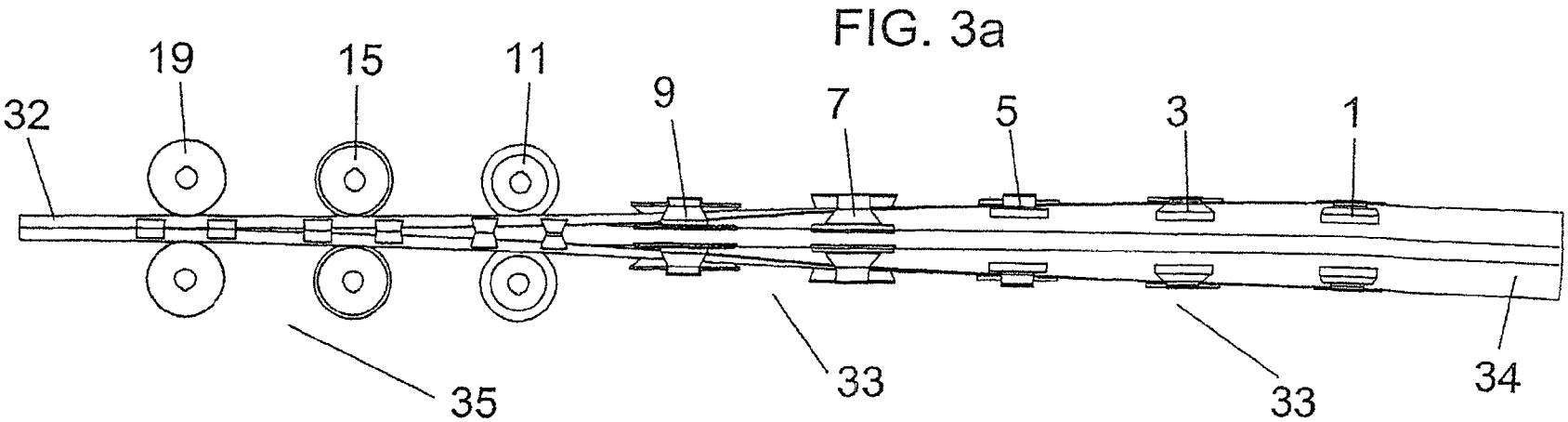
Figure 3B:
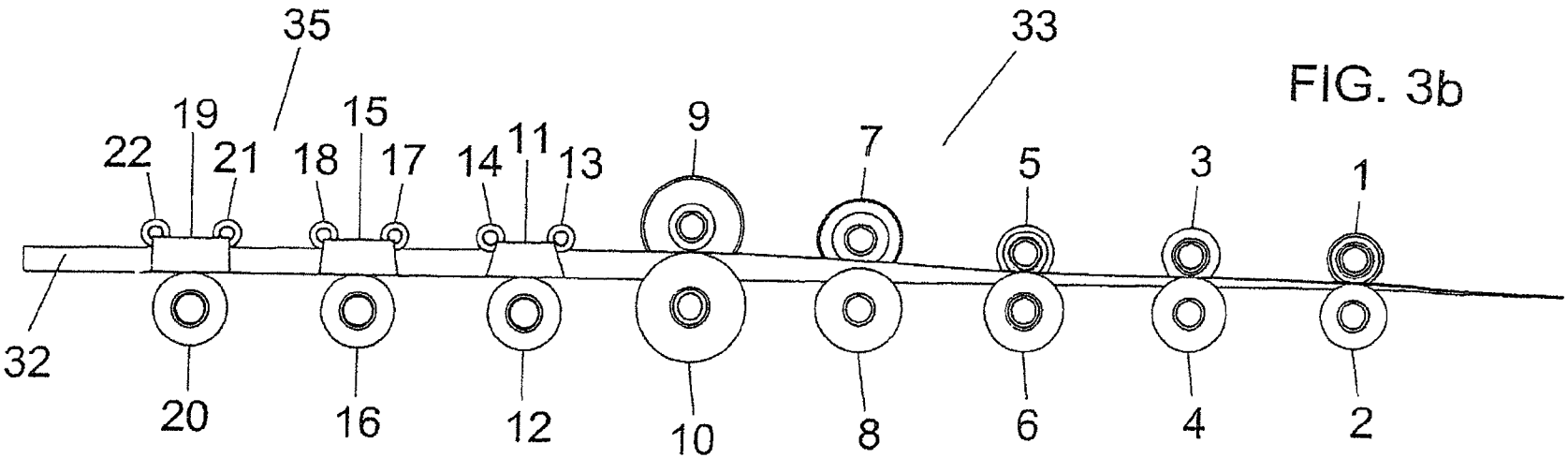
Figure 4:
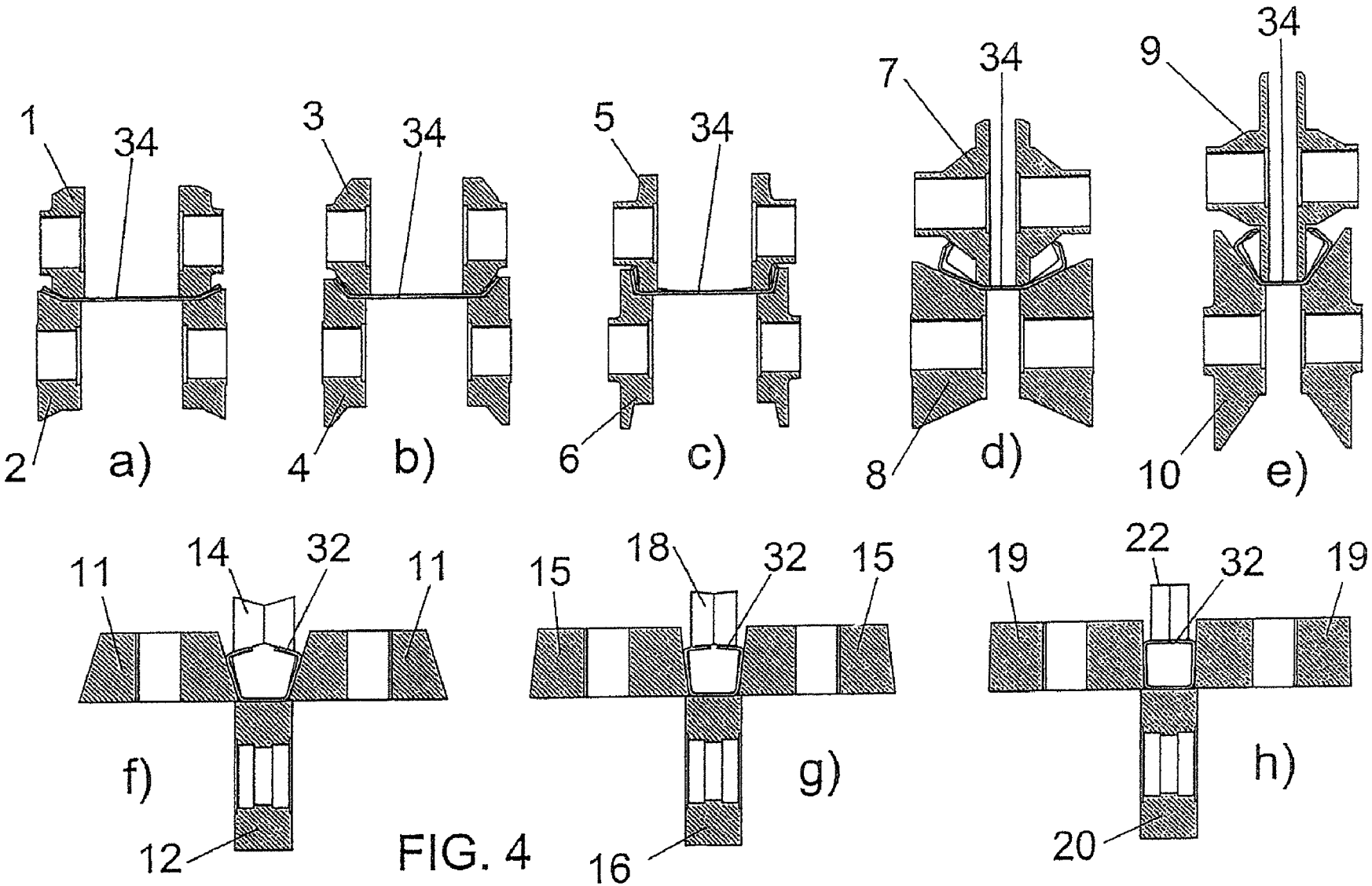
Figure 5:
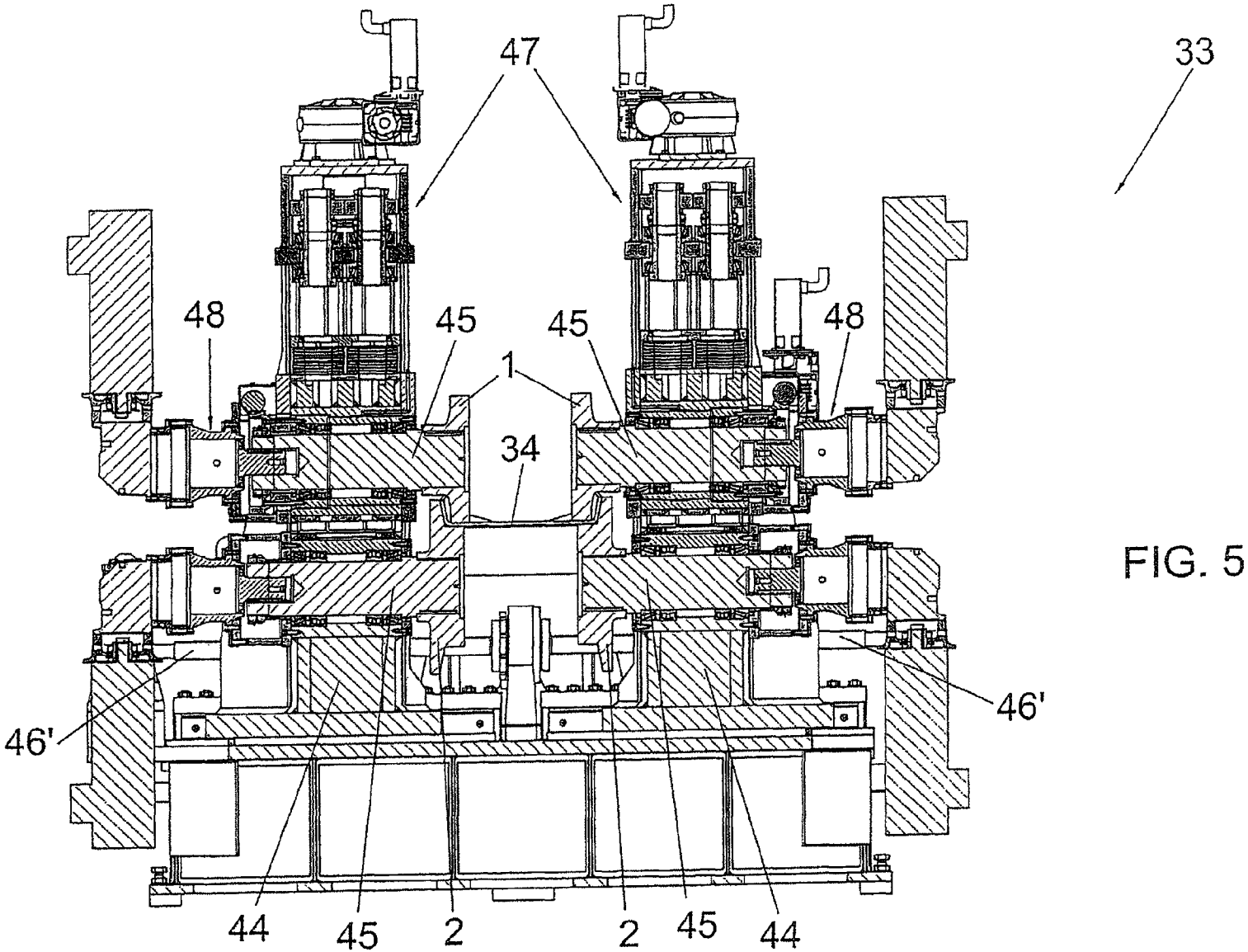
Figure 6A:
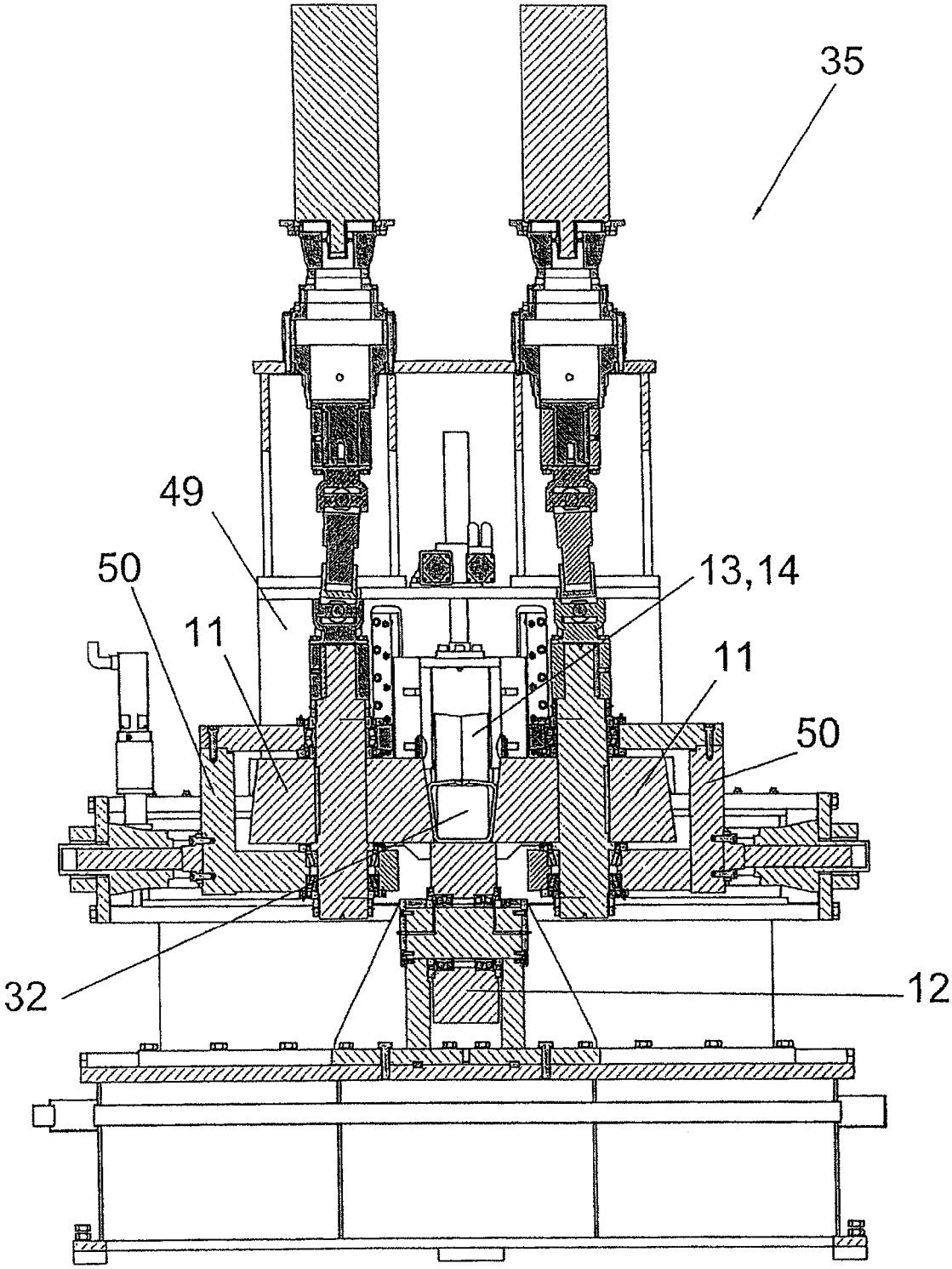
Figure 6B:
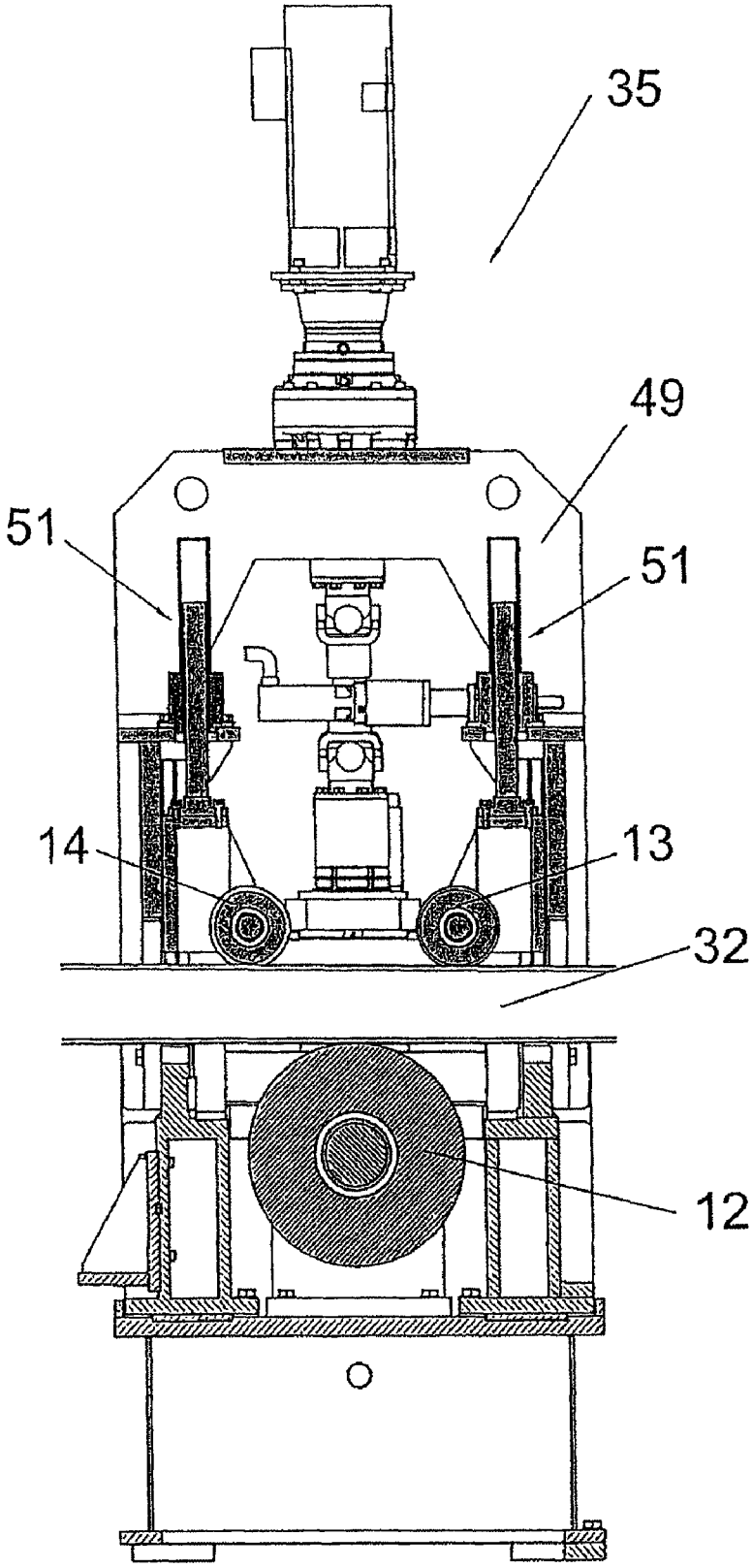

The invention will now be described with reference to purely exemplifying (and therefore not limiting) embodiments illustrated in the attached figures, wherein:

FIG. 1 schematically shows a top view (FIG. 1*a*) and a side view (FIG. 1*b*) of a machine for forming square tubes according to the invention;

FIGS. 2 and 3 schematically show a perspective side view (FIG. 2), a top view (FIG. 3*a*) and a side view (FIG. 3*b*) of the machine in FIG. 1, without covering elements and support means of the forming rolls in order to show only the forming rolls and the square tube being formed;

FIG. 4 schematically shows, in section, the forming rolls and square tube being formed in correspondence to the single forming and finishing stations;

FIG. 5 schematically shows a forming station, without covering elements, sectioned according to a plane orthogonal to the plane of the sheet strip;

FIG. 6 schematically shows a finishing station, without covering elements, sectioned, respectively, according to a plane orthogonal to the plane of the sheet strip (FIG. 6*a*) and according to a plane parallel to the plane of the sheet strip (FIG. 6*b*).

DETAILED DESCRIPTION OF THE INVENTION

In the attached figures corresponding elements will be identified by the same numerical references.

FIG. 1 schematically shows a top view (FIG. 1*a*) and a side view (FIG. 1*b*) of a machine 31 for forming square tubes 32 according to the invention, comprising, in sequence, forming stations 33 of the sheet strip 34 (which enters the machine 31 in the direction of the arrow E), at least one finishing station 35 and at least one welding station (in itself known, and omitted in FIGS. 1-4), from which the tube 32 exits in the direction of the arrow U.

In the embodiment illustrated in FIGS. 1-4, the machine 31 comprises five forming stations 33 and three finishing stations 35 but without departing from the scope of the invention, the number of forming stations 33 and finishing stations 35 may vary to meet the particular needs of a specific machine 31.

A forming station 33 will be described with reference to FIGS. 2-5 and a finishing station 35 will be described with reference to FIGS. 2-4 and 6.

FIGS. 2 and 3 schematically show a perspective view (FIG. 2), a top view (FIG. 3*a*) and a side view (FIG. 3*b*) of the machine 31 of FIG. 1, without covering elements and support and/or moving means of the forming rolls 1-22, in order to show only the forming rolls 1-22 and the square tube 32 being formed.

As it is clearly detectable by FIGS. 2 and 3, each forming station 33 comprises two pairs of forming rolls (1, 2; 3, 4; 5, 6; 7, 8; 9, 10), facing each other, which simultaneously deform both edges of the sheet strip 34: a machine 31 according to the invention is therefore much more compact and less expensive than a known machine in which each forming station comprises a single pair of forming rolls that only bend a single edge (alternatively, the right and the left one) of the sheet strip.

As is best seen by the sectional views in FIG. 4, in each forming station 33 the axes of rotation 45 (FIG. 5) of the lower rolls (2, 4, 6, 8, 10) of each pair of forming rolls (1, 2 ; 3, 4; 5, 6; 7, 8; 9, 10) are aligned with each other and parallel to the plane of the sheet strip 34; in each finishing station 35 the axes of rotation of the forming rolls (12, 16, 20) placed below the square tube 32 being formed are parallel to the plane of the sheet strip 34 and to the axes of rotation of the forming rolls (13, 14; 17, 18; 21, 22) placed above the square tube 32 being formed, while the rotation axes of each pair of forming rolls (11; 15; 19) placed to the sides of the square tube 32 being formed are parallel to each other and orthogonal to the plane of the sheet strip 34.

The Applicant has experimentally verified that this arrangement of the axes of rotation of the forming rolls is advantageous because it allows to carry out a very compact machine for forming square tubes.

The gradual deformation of the sheet strip 34 to obtain the square tube 32, visible in FIGS. 2 and 3, is best seen in FIG. 4, which schematically shows, in section, the forming rolls 1-22, the sheet strip 34 progressively deformed in the forming stations 33 (FIGS. 4*a*-4*e*) and the square tube 32 being formed in the finishing stations 35 (FIGS. 4*f*-4*h*).

FIG. 5 schematically shows a forming station 33, without covering elements, sectioned according to a plane orthogonal to the plane of the sheet strip 34.

In the embodiment shown in FIG. 5, the forming station 33 comprises the pairs of forming rolls 1 and 2, but the following description also applies to the other forming stations 33 belonging to the machine 31.

The forming station 33 includes two shoulders 44 sliding on horizontal guides, each carrying a pair of forming rolls (1, 2) carried by horizontal axes 45, means 46 suitable for allowing the two pairs of forming rolls (1,2) to perform horizontal movements in opposite directions to adapt the distance between the pairs of forming rolls (1, 2) to the width of the sheet strip 34, means 47 suitable for allowing each of the upper rolls 1 of the two pairs of forming rolls (1, 2) to perform a vertical movement to adapt the distance of the upper rolls 1 from the lower rolls 2 to the thickness of the sheet strip 34, and means 48 suitable for allowing the upper rolls 1 of the pairs of forming rolls (1, 2) to perform horizontal movements to adapt the distance between the upper rolls 1 and that from the shoulders 44 to the thickness of the sheet strip 34.

The horizontal axes 45 carrying the upper rolls 1 slide within through openings formed in the shoulder 44, while those carrying the two lower rolls 2 are fixed.

The vertical and/or horizontal movement of one of the upper rolls 1 has (or can have) a different amplitude than that of the vertical and/or horizontal movement of the other upper roll 1 to compensate for any irregularities in the thickness of the sheet strip 34.

In the embodiment shown in FIG. 5, means 46 consist of motorized endless screws 46' that engage fixed nut screws integral with the shoulders 44 and omitted in FIG. 5 for the simplification of the graphic representation; the means 47 consist of slides, sliding on vertical guides integral with a shoulder 44 and driven, for example, by motorized endless screw-nut screw groups, carrying the axis 45 of one of the upper rolls 1.

Without departing from the scope of the invention, a person skilled in the art can make the shoulder 44 and the means 46, 47 and 48 which move the forming rolls 1 and 2 by other known methods rather than those aforementioned which are merely exemplary and not limiting.

FIG. 6 schematically shows a finishing station 35, without covering elements, sectioned, respectively, according to a plane orthogonal to the plane of the sheet strip 34 (FIG. 6*a*) and according to a plane parallel to the plane of the sheet strip 34 (FIG. 6*b*).

In the embodiment shown in FIG. 6, the finishing station 35 comprises the forming roll 12 placed below the square tube 32 being formed, the forming rolls 11 placed at the sides of the square tube 32 being formed and the forming rolls 13 and 14 placed above the square tube 32 being formed, but the following description also applies to the other finishing stations 35 pertaining to the machine 31.

The finishing station 35 comprises a shoulder 49 that carries the forming roll 12 placed below the square tube 32 being formed, means 50 suitable for allowing the forming rolls 11 placed at the sides of the square tube 32 being formed to perform horizontal movements and means 51 suitable for allowing the forming rolls (13, 14) placed above the square tube 32 being formed to perform vertical movements.

To compensate for any irregularities in the thickness of the sheet strip 34, the horizontal movement of one of the forming rolls 11 placed at the sides of the square tube 32 has (or can have) a different amplitude than the horizontal movement of the forming roll 11 placed at the other side of the square tube 32 being formed and the vertical movement of the forming roll 13 placed above the square tube 32 being formed has (or can have) a different amplitude than the vertical movement of the other forming roll 14 placed above the square tube 32 being formed.

In the embodiment shown in FIG. 6, the means 50 consist of slides, sliding on horizontal guides integral with the shoulder 49, moved by jacks and the means 51 consist of slides, sliding on vertical guides integral with the shoulder 49 and moved by jacks, but without departing from the scope of the invention, a person skilled in the art can make the shoulder 49 and the means 50 and 51 by other known methods rather than those aforementioned which are merely exemplary and not limiting.

Without departing from the scope of the invention, a person skilled in the art can apply to the variable linear geometry machine for forming square tubes previously described all the changes and improvements suggested by normal experience and/or the natural development of the art.

The invention claimed is:

1. A machine (31) for continuously forming square tubes (32), comprising in sequence:

at least one forming station (33) configured for progressively bending a sheet strip (34);

at least one finishing station (35) configured for further approaching edges (36) of the bent sheet strip (34); and at least one welding station of the square tube (32), wherein:

each forming station (33) comprises two pairs of motorized forming rolls (1, 2; 3, 4; 5, 6; 7, 8; 9, 10), mounted onto axes (45) parallel to a plane of the sheet strip (34), which are facing each other and are configured to perform movements parallel to the plane of the sheet strip (34), upper rolls (1, 3, 5, 7, 9) of each pair (1, 2; 3, 4; 5, 6; 7, 8; 9, 10) being configured to perform movements parallel and/or orthogonal to the plane of the sheet strip (34), each finishing station (35) comprises at least one idle forming roll (12; 16; 20) placed below the square tube (32) being formed; two idle forming rolls (11; 15; 19), placed at sides of the square tube (32) being formed, which perform movements parallel to the plane of the sheet strip (34), and two idle forming rolls (13, 14; 17, 18; 21, 22), placed above the square tube (32) being formed, configured to perform movements orthogonal to the plane of the sheet strip (34).

2. The machine (31) according to claim 1, wherein the two pairs of motorized forming rolls (1, 2; 3, 4; 5, 6; 7, 8; 9, 10) belonging to each forming station (33) simultaneously deform both edges of the sheet strip (34).

3. The machine (31) according to claim 1, wherein movements parallel to the plane of the sheet strip (34) of the two pairs of motorized forming rolls (1, 2; 3, 4; 5, 6; 7, 8; 9, 10) of the forming station (33) are simultaneous.

4. The machine (31) according to claim 1, wherein movements parallel and orthogonal to the plane of the sheet strip (34) of one of the upper rolls (1, 3, 5, 7, 9) of one pair of the two pairs of motorized forming rolls (1, 2; 3, 4; 5, 6; 7, 8; 9, 10) belonging to the forming station (33) are independent from those of another upper roll (1, 3, 5, 7, 9) of a same pair of the motorized forming rolls (1, 2; 3, 4; 5, 6; 7, 8; 9, 10).

5. The machine (31) according to claim 1, wherein axes of rotation (45) of lower rolls (2, 4, 6, 8, 10) of each pair of the two pairs of motorized forming rolls (1, 2; 3, 4; 5, 6; 7, 8; 9, 10) belonging to the forming station (33) are aligned to each other and parallel to the plane of the sheet strip (34).

6. The machine (31) according to claim 1, wherein in the finishing station (35), axes of rotation of the idle forming rolls (12, 16, 20) placed below the square tube (32) being formed are parallel to the plane of the sheet strip (34), and axes of rotation of the two idle forming rolls (13, 14; 17, 18; 21, 22) placed above the square tube (32) being formed and of rotation of each pair of the two idle forming rolls (11, 15, 19) placed at the sides of the square tube (32) being formed are parallel to each other and orthogonal to the plane of the sheet strip (34).

7. The machine (31) according to claim 1, wherein in the finishing station (35), movement parallel to the plane of the sheet strip (34) of the forming idle roll (11, 15, 19) placed at one side of the square tube (32) being formed is independent from the movement parallel to the plane of the sheet strip (34) of the idle forming roll (11, 15, 19) placed at another side of the square tube (32) being formed, and movement orthogonal to the plane of the sheet strip (34) of one of the idle forming rolls (13, 14; 17, 18; 21, 22) placed above the square tube (32) being formed is independent from the movement orthogonal to the plane of the sheet strip (34) of another of the idle forming rolls (14, 13; 18, 17; 22, 21) placed above the square tube (32) being formed.

8. The machine (31) according to claim 1, wherein the forming station (33) further comprises:

means for support (44) configured for sliding on guides parallel to the plane of the sheet strip (34), each of said means for support (45) carrying a pair of the motorized forming rolls (1, 2; 3, 4; 5, 6; 7, 8; 9, 10) carried by axes (45) parallel to the plane of the sheet strip (34);

means (46) for allowing the pairs of the motorized forming rolls (1, 2; 3, 4; 5, 6; 7, 8; 9, 10) to perform opposite movements parallel to the plane of the sheet strip (34) suitable for adapting the distance between the pairs of the motorized forming rolls (1, 2; 3, 4; 5, 6; 7, 8; 9, 10) to the width of the sheet strip (34);

means (47) for allowing each of the upper rolls (1, 3, 5, 7, 9) of the pairs of motorized forming rolls (1, 2; 3, 4; 5, 6; 7, 8; 9, 10) to perform a movement orthogonal to the plane of the sheet strip (34) suitable for adapting a distance of the upper rolls (1, 3, 5, 7, 9) from lower rolls (2, 4, 6, 8, 10) of each pair of the motorized forming rolls (1, 2; 3, 4; 5, 6; 7, 8; 9, 10) to the thickness of the sheet strip (34); and means (48) for allowing the upper rolls (1, 3, 5, 7, 9) of the pairs of the motorized forming rolls (1, 2; 3, 4; 5, 6; 7, 8; 9, 10) to perform movements parallel to the plane of the sheet strip (34) for adapting the distance between the upper rolls (1, 3, 5, 7, 9) and from the support means (44) to a thickness of the sheet strip (34), the axes (45) carrying the upper rolls (1, 3, 5, 7, 9) being configured for sliding within through openings formed in the means for support (44), with the axes (45) carrying the lower rolls (2, 4, 6, 8, 10) being fixed.

9. The machine (31) according to claim 8, wherein the movements orthogonal and/or parallel to the plane of the sheet strip (34) of one upper roll (1, 3, 5, 7, 9) of the pair of motorized forming rolls (1, 2; 3, 4; 5, 6; 7, 8; 9, 10) are different in width with respect to those of another upper roll (1, 3, 5, 7, 9) of a same pair of the motorized forming rolls (1, 2; 3, 4; 5, 6; 7, 8; 9, 10).

10. The machine (31) according to claim 1, wherein the finishing station (35) further comprises:

means for support (49) configured for carrying the idle forming roll (12, 16, 20) placed below the square tube (32) being formed;

means (50) for allowing the idle forming rolls (11, 15, 19) placed at the sides of the square tube (32) being formed to perform movements parallel to the plane of the entering sheet strip (34); and means (51) for allowing the idle forming rolls (13, 14; 17, 18; 21, 22) placed above the square tube (32) being formed to perform movements orthogonal to the plane of the entering sheet strip (34).

11. The machine (31) according to claim 10, wherein movement parallel to the plane of the entering sheet strip (34) of one of the idle forming rolls (11, 15, 19) placed at one side of the square tube (32) being formed is different in width with respect to the movement parallel to the plane of the entering sheet strip (34) of the idle forming roll (11, 15, 19) placed at another side of the square tube (32) being formed and in that the movement orthogonal to the plane of the entering sheet strip (34) of the idle forming roll (13, 14) placed above the square tube (32) being formed is different in width with respect to the movement orthogonal to the plane of the entering sheet strip (34) of the other idle forming roll (13, 14) placed above the square tube (32) being formed.

* * * * *